United States Patent [19]

Peckinpaugh et al.

[11] 4,396,570

[45] Aug. 2, 1983

[54] NYLON SPIN-DRAW PROCESS WITH STEAM CONDITIONING

[75] Inventors: Frank L. Peckinpaugh, Petersburg; Michael K. Westmoreland, Midlothian, both of Va.

[73] Assignee: Allied Corporation, Morris Township, N.J.

[21] Appl. No.: 259,402

[22] Filed: May 1, 1981

[51] Int. Cl.[3] ..... D01D 5/16

[52] U.S. Cl. ..... 264/210.3; 264/210.7; 264/210.8

[58] Field of Search ..... 264/237, 176 F, 210.3, 264/210.7, 210.8

[56] References Cited

U.S. PATENT DOCUMENTS

| | | | |
|---|---|---|---|
| 2,289,860 | 7/1942 | Babcock | 264/176 F |
| 3,039,171 | 6/1962 | Hume et al. | 264/288.8 |
| 3,291,880 | 12/1966 | Pitzl | 264/176 F |
| 3,346,684 | 10/1967 | Gosden | 264/176 F |
| 3,414,646 | 12/1968 | Pitzl | 264/210.5 |
| 3,550,369 | 12/1970 | Pitzl | 428/400 |
| 3,732,346 | 5/1973 | Mallonee et al. | 264/210.3 |
| 3,761,556 | 9/1973 | Thom et al. | 264/210.3 |
| 3,994,121 | 11/1976 | Adams | 264/103 |
| 4,204,828 | 5/1980 | Peckinpaugh et al. | 264/237 |
| 4,229,500 | 1/1980 | Adachi et al. | 264/210.3 |
| 4,237,187 | 12/1980 | Raybon et al. | 264/103 |

FOREIGN PATENT DOCUMENTS

| | | | |
|---|---|---|---|
| 43-26333 | 11/1968 | Japan | 264/342 R |
| 44-17565 | 8/1969 | Japan | 264/176 F |
| 46-3809 | 1/1971 | Japan | 264/210.3 |
| 52-27846 | 3/1977 | Japan | 264/210.3 |
| 52-55717 | 5/1977 | Japan | 264/210.3 |

*Primary Examiner*—Jay H. Woo

*Attorney, Agent, or Firm*—Richard A. Anderson

[57] ABSTRACT

This invention is a continuous process for spinning and drawing polycarbonamide filaments as a continuous running length comprising spinning the filaments Y from the molten polymer through a spinnerette 3 into a quench stack 4 and immediately quenching the freshly spun filaments in a quench stack with a flowing quench medium and immediately applying a yarn finish so that after quenching and applying finish, the surface temperature of the filaments is below the second order transition temperature for the filaments at the ambient conditions, and immediately applying steam in a chamber 15 around the continuous running length of filaments at a temperature at from about 60° C. to 95° C. for periods from about 0.03 to 3 seconds and immediately drawing the filaments; and the apparatus to accomplish that process.

9 Claims, 2 Drawing Figures

NYLON SPIN-DRAW PROCESS WITH STEAM CONDITIONING

BACKGROUND OF THE INVENTION

This invention relates to spinning and drawing of synthetic fibers, particularly to an improved spin-draw process to improve ozone fading resistance of dyed nylon yarn. More particularly, the spin-draw process has a steam conditioning step immediately after spinning.

In a coupled spin-draw process, such as disclosed in U.S. Pat. No. 3,732,346, herein incorporated by reference, the yarn produced has a deficiency in that it tends to fade after dyeing when exposed to ozone in a fabric such as a carpet. For purposes of this discussion, this fading caused by exposure of ozone in the atmosphere is measured by $\Delta E$ values determined by exposing samples of fabric according to AATCC Test Method No. 129-1975 and reading differences in fading according to AATCC Test Method No. 153-1978 (Hunter). All samples were dyed Disperse Olive II as follows:

1. Weigh sleeves.
2. Fill with cold water at 30:1 ratio (goods to water).
3. Add dye and chemicals and run cold for 10 minutes.
   0.665 Percent Standard Olive II
   2.000 Percent trisodium phosphate (TSP)
   0.500 Percent Triton X-100
4. Bring to 205° F. (96° C.) at 40° F. (4.5° C.) per minute and hold for 60 minutes.
5. Drop bath.
6. Rinse with cold water for 10 minutes.
7. Drop bath.
8. Remove and extract.
9. Dry.

Standard Disperse Olive II is 0.082 percent Latyl Cerise Y (CI Disperse Red 55:1); 0.440 percent Celliton Yellow GA (CI Disperse Yellow 3); 0.143 percent Celanthrene Blue CR (Celanthrene Blue CR is a mixture of CI Disperse Blue 7 and CI Disperse Violet 28 by duPont).

It is known in U.S. Pat. No. 4,204,828, hereby incorporated by reference, to use flowing air, then fog to quench synthetic filaments.

In U.S. Pat. No. 4,074,405, hereby incorporated by reference, texturing by use of a rotating screen to impinge yarn from a jet with an enclosure over the point of impingement is taught.

Several patents teach steam conditioning of freshly spun yarn; for a coupled process see U.S. Pat. Nos. 3,039,171; 3,414,646 and 3,550,369; for the uncoupled "split" or undrawn yarn process see U.S. Pat. Nos. 3,994,121; 3,291,880; 2,289,860 and 3,364,684, all hereby incorporated by reference.

SUMMARY

This invention is a continuous process for spinning and drawing polycarbonamide filaments as a continuous running length comprising spinning the filaments from the molten polymer through a spinnerette into a quench stack and immediately quenching the freshly spun filaments in a quench stack with a flowing quench medium and immediately applying a yarn finish so that after quenching and applying finish the surface temperature of the filaments is below the second order transition temperature for the filaments at the ambient conditions, and immediately applying steam in the chamber around the continuous running length of filaments at a chamber temperature of from about 60° C. to 95° C. for a period of from about 0.03 to about 3 seconds and immediately drawing the filaments. Preferably, the polycarbonamide is nylon 6, and the quenching medium is air. More preferably, the quenching medium is air followed by a fog of atomized water. Also, it is preferable to set the filaments at a desired denier by passing them over a driven godet roll after applying the yarn finish and before applying steam. The preferred period for applying steam is from between about 0.1 to about 2 seconds. The preferred draw ratio is from about 2.2 to about 4.2.

Additionally, the filaments can be textured immediately following the drawing. The preferred texturing is by use of a jet of a heated medium. The preferred heated medium is steam used to impinge the filaments on a moving screen in a cavity.

During the process, it is preferred that the filaments be cooled to a surface temperature of between about 25° C. and 34° C. prior to entry into the steam chamber. The process in its most detailed form is the combination of all the above mentioned conditions, with the drawing taking place in two stages between sets of driven rolls, the first stage draw ratio being between about 1.1 and about 1.2, in the second stage draw ratio being about 2.5 and 3; the continuous running length of filaments taken up at a speed of between about 2500 and 4000 meters per minute and the molten polymer being fed to the spinnerette at a rate of from about 34 and 48 pounds (15 and 22 kilograms) per hour.

The apparatus of this invention for a continuous process for spinning and drawing polyamide filaments as a continuous running length comprises in combination a spinnerette for spinning polyamide filaments into a cross-flow quench stack, a nozzle to atomize water into a fog or mist, means to exhaust the quench stack, means to draw the filaments, filament takeup means, and means for applying steam to the continuous running length of filaments. The spinnerette is located at the entrance of the quench stack and the means to exhaust the air and the nozzle both communicate with the quench stack. The nozzle atomizes and communicates with the quench stack at a point well away from the spinnerette, and the means for applying steam is interposed between the quench means and the drawing means. By "well away from the spinnerette" is meant from a few feet to point past halfway down the quenching system. The preferred position is shown in FIG. 1 where the fogger is located at the bottom of the cross-flow system which is also near the top of the quench tube. Preferably, a godet roll or godet roll with idler is used to forward the filaments from the quench stack into the means for applying steam to the filaments. Also, additionally there can be texturing means for the filaments interposed between the drawing means and the take-up means. The preferred texturing means is a means to impose the filaments on a moving screen within a cavity, preferably a jet, and even more preferably a steam jet.

DISCUSSION

The combination of flowing air quench followed by applying steam in the conditioning tube, where the yarn filaments entering the tube must be cooled to below the second order transition temperature ($T_g$), is not taught in the prior art, nor is the combination of cross-flow air quench with fog applied lower in the quench stack, with relatively long-term steam conditioning immediately after quench and finish application, with the same entering yarn below the $T_g$ condition. The use of these processing combinations in a highspeed, coupled process provides yarn which in dyed fabric gives highly superior resistance to ozone fading.

DESCRIPTION OF THE PREFERRED EMBODIMENT

Figure 1:
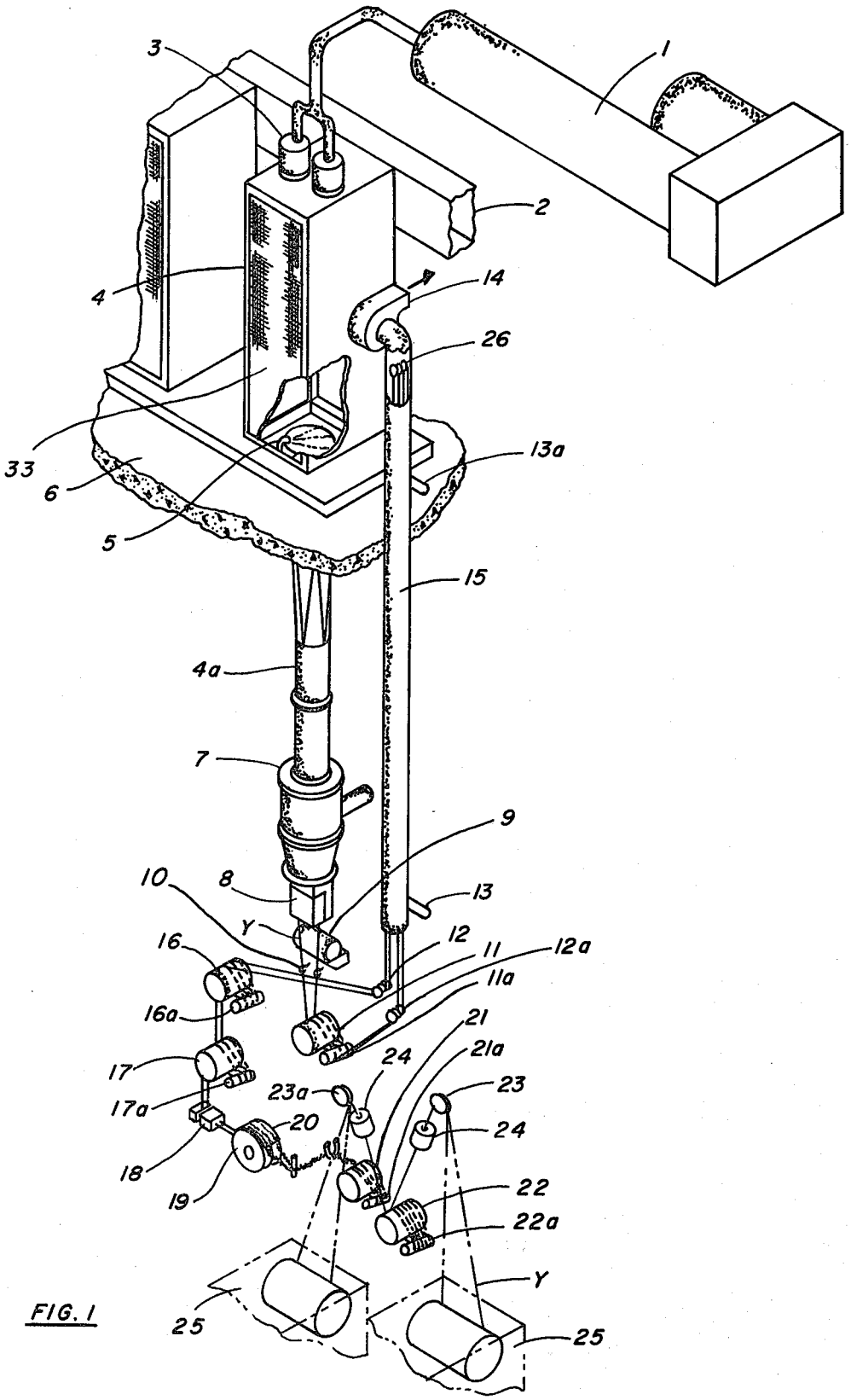
FIG. 1 is a schematic showing the apparatus used to practice the process of this invention.

As shown in FIG. 1, extruder 1 extrudes molten synthetic polyamide through spinnerettes 3 forming continuous running length of filaments shown as Y at the bottom of the quench stack 4. Any gaseous monomer around the spinnerette face is exhausted by monomer exhaust 2. Quenching medium would flow across quench stack 4 to exit at screen 33. After being quenched only by air in the cross-flow quench stack, a fogger 5 is used to create an atomized fog of fine water droplets to continue to quench the continuous running length of synthetic nylon filaments. The filaments continue to run downward through the floor 6 and quench tube 4A to exit at the bottom of the tube 4A at clam shell opening 8 and end of quench tube 4A which have means (unshown) to catch any condensed water droplets running down the inside of the tube 4A. Also quench exhaust 7 will exhaust the air and fog from quench tube 4A. As filaments Y exit from tube 4A, finish is applied with finish roll 9 to the filaments. Thereafter, the filaments pass through turning and converging guides 10 to godet roll 11 and its accompanying idler roll 11A. The filaments then pass around idler guide wheel 12A to enter conditioning tube 15 which has saturated steam inlets at 13 and 13A. Steam is exhausted at the top of conditioning tube 15 through exhaust 14. Filaments reverse direction over idler guide wheel 26 and exit tube 15 just above idler guide wheel 12 around which they pass to godet roll 16 and accompanying idler roll 16A. The filaments are drawn between godet roll 16 and godet roll 17 with accompanying idler 17A. They also may be slightly drawn between godet roll 11 and godet roll 16. After leaving the godet roll 17, filaments enter steam jet 18 which causes the filaments to impinge on rotatable screen 19 within cavity 20. The yarn is crimped by impingement on screen 19, thereby becoming textured. From there the yarn is slightly relaxed between godet roll 21 and accompanying idler roll 21A and godet roll 22 and accompanying idler roll 22A. Then the yarn passes across lost end detectors and guides 23 and 23A through comminglers 24 to the winders 25.

Figure 2:
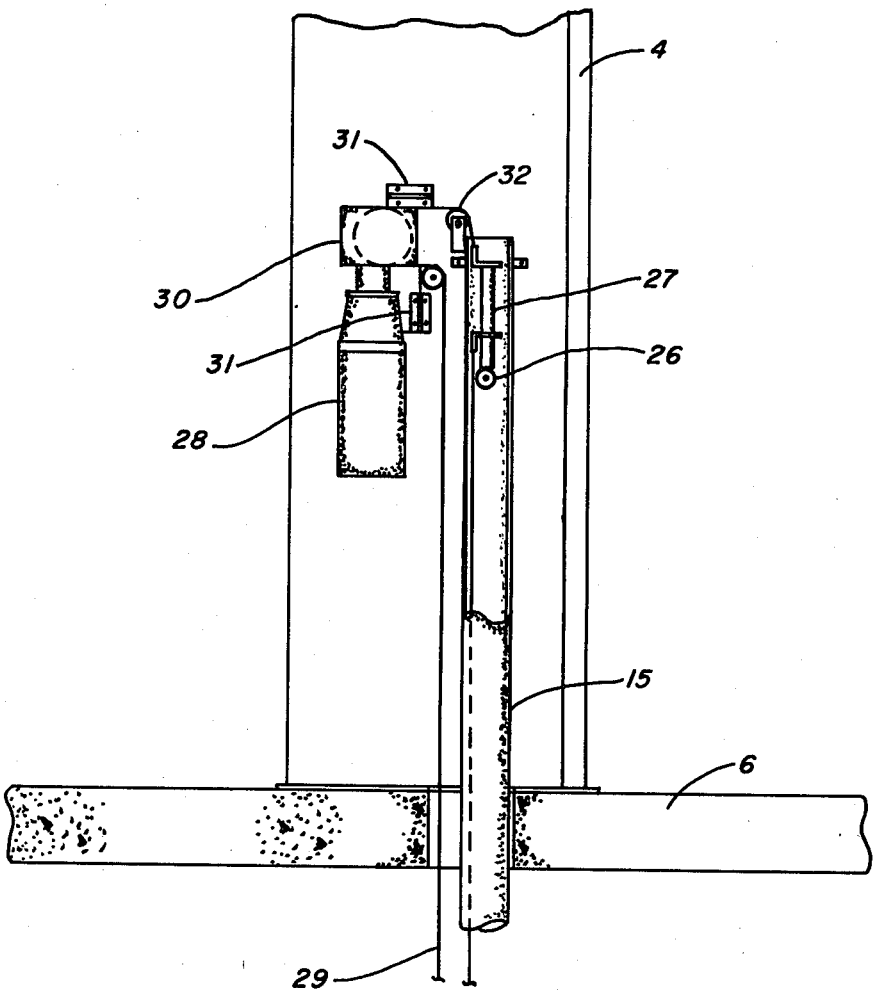
FIG. 2 is a partial schematic showing the apparatus used to string-up filaments into the conditioner tube.

In FIG. 2 the apparatus for string-up of filaments into the conditioning tube 15 is shown above the floor 6. The idler guide wheel 26 is shown in the uppermost position within tube 15, mounted on the sliding wheel mount 27 which is a plug, slidably mounted in tube 15, and attached to cable 29 at top and at bottom. Cable drive motor 28 powers friction drive wheel 30 to move cable 29 up or down, thereby moving mount 27 and wheel 26 up or down as desired for string-up described below. Cable 29 passes over pulleys 32 at top and bottom of tube 15. The assembly of motor 28 and drive wheel 30 are mounted on the upper portion of quench stack or cabinet 4 with mounting brackets 31.

EXAMPLE

Using the apparatus shown in the Figures, light stable bright nylon 6 polymer chips are melted and extruded to exit spinnerettes 3 at a temperature of about 265° C. at about 40 pounds (18 kg) per hour. The spinnerette orifices are asymmetric Y-shaped. A vacuum of 2–7 inches (0.79–2.8 cm) of water is created in the monomer exhaust 2 to exhaust the gaseous monomer at the spinnerette faces. Air flows in a cross-flow flat profile pattern in quench stack 4 at 75 to 100 feet (23 to 31 meters) per minute. Water is atomized to form fog at fogger 5 at a rate of 0.03 gallons (0.11 liters) per minute. Quench exhaust 7 withdraws air and fog from the quench tube with a vacuum of about 1.2 inches (0.47 cm) of water. The yarn filaments are cooled in the quench stack 4 and pass over finish roll 9 through guides 10 to unheated first godet roll 11 and idler 11A which operates at 1897 rpm. Filaments from godet roll 11 are measured for surface temperature with a Trans-met noncontact temperature measuring system, and surface temperature is found to be 26° C. Filaments then pass around guide 12A and enter steam conditioning tube 15 which has a saturated steam entering inlet 13 at about 12 pounds (5.4 kg) per hour and inlet 13A at about 3 pounds (1.36 kg) per hour. Steam is exhausted through exhaust 14 at the top of conditioning tube 15. Filaments reverse direction over guides 26 and leave tube 15 passing over guide 12 to unheated godet roll 16 and idler 16A operating at 2200 rpm. Thus, the draw ratio between godet 11 and godet 16 is 1.16. However, the filaments naturally extend or expand by 8 percent in length, so they are stretched only 1.08 times. The filaments then pass to godet 17 and idler 17A operating at 6260 rpm for a draw ratio of 2.85 between godet rolls 16 and 17. Godet roll 17 is heated to 155° C.

Yarn surface temperature leaving the conditioning tube 15 is 60° C. Temperature of the outer shell of the insulated aluminum tube 15 is about 70° C. Yarn tensions are as follows:

between roll 11 and tube 15—10 to 20 grams
between tube and roll 16—40 to 50 grams
between roll 16 and roll 17—1000 to 1100 grams.

Filaments then pass through the jet 18 to be textured by impinging on rotatable screen 19 in cavity 20 as shown in FIG. 6 of U.S. Pat. No. 4,074,405 operating with steam at 325° C. flowing at 23 pounds per hour (10.4 kg/hr). Filaments then pass to godet roll 20 and idler 20 then to godet 21 and idler 21A, then through comminglers 24 to be taken up on winders 25 at 2820 meters per minute.

When first starting the spin-draw-texturing equipment, following is the string-up procedure for the conditioning tube. String-up for all other apparatus is conventional.

STRING-UP PROCEDURE—CONDITIONING TUBE

As shown in FIG. 2, the conditioning tube 15 is equipped with a lifting cable 29 and drive motor 28 to move the yarn turning guide wheels 26 up from the take-up panel string-up area to the top position as shown in FIGS. 1 and 2. The relative locations of the components are shown in FIG. 2.

To string up the conditioning tube 15, the following procedure is used:

1. The yarn is received from the quench tube clam shell 8 to a hand-held aspirator.

2. The yarn is passed over the finish roll 9 and separation of the two ends is obtained at the turning and converging guides 10. (Note: Normal twisting in the aspirator serves to obtain separation of the ends.)

3. With guide 26 in the lower position, using the aspirator the yarn is wrapped around roll 11 and idler 11A six times, then passed under guide 12A over guide 26 and then guide 12. The operator pushes the lift switch causing guide 26 to move to the upper position. There is no need to wait for guide 26 to reach top position before continuing.

4. The operator then wraps godet roll 16 and idler 16A with 10 wraps and godet roll 17 and idler 17A with seven wraps.

5. The yarn is then strung-up as in normal texturing, commingling, and take-up processes to winders 25.

The following runs were made to compare the yarn of this process with yarn of the prior art made with a split process, that is, spinning onto large bobbins, then drawing about 3.8 times and texturing on a yarn processing panel using the texturing jet of U.S. Pat. No. 3,409,956 and commingling using the apparatus of U.S. Pat. No. 3,828,404. Runs 1, 3 and 5 are prior art control yarn by that process. Run 2 is also comparative, showing yarn made by the above Example, but without the steam conditioning tube. Ozone fading and crystallinity data show the yarn of this coupled process using conditions given in the above Example has overcome the problems of the prior art coupled process to produce yarn with crystallinity and ozone fading equivalent or better than yarn made by the prior art split process. See the following table. All yarn is 1125 denier from nylon 6 light stable bright polymer.

TABLE 1

| | Ozone Fading Δ E (Hunter) (1) | | Crystallinity Alpha/Beta/Gamma (2) | | |
|---|---|---|---|---|---|
| Run | Package (3) | Heat Set (4) | From Package (3) | Heat Set (4) | Conditions |
| 1 | 7.22 | 14.25 | 30–40 Alpha | 64/0/14 | A |
| 2 | 10.16 | 13.66 | Low alpha and high beta | 69/10/0 | B |
| 3 | 7.1 | 12.3 | 30–40 Alpha | 68/0/0 | A |
| 4 | 6.7 | 10.0 | 38/30/0 | 67/0/0 | C |
| 5 | 7.5 | 12.1 | 40/20/0 | 64/3/0 | A |
| 6 | 6.7 | 11.0 | 7/66/0 | 63/8/0 | D |
| 7 | 7.2 | 10.2 | 9/64/0 | 62/5/0 | E |

(1)Using Disperse Olive II according to the method given in the Background of the Invention, 3 cycles.
(2)Crystalline phases measured by X-ray diffraction, are described in J. Polymer Science, Vol. 1, pp. 603–608 (1963), letter by L. Roldan. The measurement is described below.
(3)Yarn from the package taken up on the winder of the process.
(4)Yarn that has been steam autoclaved at 270° F. (132° C.) for 0.5 hour.
A — Prior art split process yarn, described above.
B — Yarn processed at 34 lbs/hr (15.4 kg/hr) of polymer through the spinnerette, 3.42 draw ratio, as in the above Example, but without using the steam conditioning tube.
C — Yarn from the process of this invention, above Example, 39 lbs/hr (17.7 kg/hr) through the spinnerette, two passes through the conditioning tube.
D — Yarn from the process of this invention, above Example, 40 lbs/hr (18.1 kg/hr) of polymer through the spinnerette, 3.3 draw ratio, one pass through the tube, one-third less steam flow to the lower steam inlet.
E — Same as above, but 42 lbs/hr (19.1 kg/hr) of polymer through the spinnerette.

PROCEDURE FOR X-RAY CRYSTALLINITY MEASUREMENT OF NYLON 6 YARN

1. Wind the yarn around the sample holder in a way that the yarns are parallel and tightly packed to each other for Phillips Electronic X-ray Diffraction Unit.
2. Place the sample holder into the flat rotating specimen holder which has been previously set for transmission position.
3. Set the X-ray generator to produce 40 kv/30 ma beam from a high intensity Cu-source.
4. Set the goniometer speed to 2°/minute.
5. Set the electronic panel to the following conditions:
   (a) Scintillation voltage—0.8 kv
   (b) PHA base—200
   (c) PHA window—604
   (d) Range—5 kv×0.5
   (e) Time constant—0.5 second
6. Open the X-ray shutter and scan meridionally, equatorially, and rotationally. Draw base lines for the three scans.
7. Determine the amorphous content from the meridional scan (20 theta=25−19°) by matching with the master amorphous curve (a family of amorphous curves).
8. Transfer the amorphous curve to the rotational scan with the amorphous peak at 20.6°. Measure the peak height to the base.
9. Use the $alpha_1$, $alpha_2$, peak locations from the equatorial scan to locate the peaks on the rotational scan. From each location, draw a line perpendicular to the base line.
10. Draw the respective best tangent from both peaks on the outside scanned curves.
11. Draw a symmetrical tangent on the inside curve from both peaks.
12. Draw a curve through the point of intersection to the base that resembles one of the master amorphous curves.
13. The average distance from $alpha_1$, $alpha_2$, peaks to the curve from (12) is the alpha content.
14. The distance between the curve from (12) and the amorphous curve represents beta and gamma contents.
15. Determine one-half beta peak height from meriodional. If the height is larger than (14) there is no gamma. If the height is less than (14) the remainder is gamma.
16. Determine the percent amorphous, alpha, beta and gamma contents from the heights in (8), (13), (14), and (15).

SUMMARY OF BENEFITS OF INVENTION

The process and apparatus of this invention makes possible use of a high-speed, coupled process to spin, draw and texture yarn, without manual handling, to a sales package on the winder, producing yarn that is less susceptible to ozone fading than the more expensive split process requiring manual transfer of packages between spinning takeup and the draw-texturing process. The prior art yarn of Table I, Runs 1, 3, and 5 has ΔE fading of a little over 7 from the package and 12 to 14 autoclaved (heat-set). Comparative Run 2, coupled process without the steam conditioning tube process, gives very high, above 10, ΔE fading of yarn from the package. This is due to the low alpha crystallinity content of that yarn. Use of the steam conditioning tube in Runs 4, 6 and 7 (this invention) raised the alpha content sufficiently to improve the fading, ΔE, to between 6.7 and 7.1, better than the split process. Runs 1, 3, and 5, and far better than the coupled process without steam conditioning, Run 2. Also, the fading, ΔE, of heat-set yarn of this invention was improved to between 10 and 11 as opposed to between 12 and 14 for the prior art.

We claim:

1. A continuous process for spinning and drawing nylon 6 filaments as a continuous running length comprising (a) spinning the filaments from the molten polymer through a spinnerette into a quench stack, and immediately (b) quenching the freshly spun filaments in a quench stack with a flowing quench medium followed by a fog of atomized water and immediately (c) applying a yarn finish so that after quenching and applying finish the surface temperature of the filaments is below 34° C. and above 25° C. and immediately (d) applying steam in a chamber around the continuous running length of filaments at a chamber temperature of from about 60° C. to 95° C. for a period of from about 0.03 to about 3 seconds, (e) drawing the filaments.

2. The process of claim 1 wherein the quenching medium is air.

3. The process of claim 1 wherein immediately following applying the yarn finish and before applying steam, the filaments are set at a desired denier by passing over a driven godet roll.

4. The process of claim 1 wherein the steam is applied for a period of from between about 0.1 to about 2 seconds.

5. The process of claim 1 wherein the filaments are drawn to a draw ratio of from between about 2.2 to about 4.2.

6. The process of claim 1 wherein the filaments are textured immediately following drawing.

7. The process of claim 6 wherein texturing is by use of a jet of heated medium.

8. The process of claim 6 wherein the jet uses steam to impinge the filaments upon a moving screen in a cavity.

9. The process of claim 1 wherein the quenching medium is a cross-flow of air the filament is set at a desired denier by passing over a driven godet roll, the steam is applied at a chamber temperature of from between about 60° and about 90° C. for a period of from about 0.1 to 2 seconds, the drawing takes place in two stages between sets of driven rolls, the first stage draw ratio being between 1.1 and about 1.2, the second stage draw ratio being between about 2.5 and about 3, the filaments are textured after drawing with steam jet which impinges the filaments on a moving screen in a cavity, and the continuous running length of filaments are taken up at a speed of between about 2500 and 4000 meters per minute and molten polymer is fed to the spinnerette at a rate of from between about 34 and 48 pounds (15 and about 22 kilograms) per hour.

* * * * *